United States Patent [19]

Lovell

[11] 3,948,073

[45] Apr. 6, 1976

[54] APPARATUS AND METHOD OF METAL FORMING

[76] Inventor: Robert Lovell, 224 Burningtree Drive, Naples, Fla. 33940

[22] Filed: Sept. 27, 1974

[21] Appl. No.: 509,778

[52] U.S. Cl. ..... 72/256; 72/266; 72/356; 72/358

[51] Int. Cl.[2] ..... B21D 51/24

[58] Field of Search ..... 72/256, 266, 267, 343, 72/352, 356, 358, 359

[56] References Cited

UNITED STATES PATENTS

| | | | |
|---|---|---|---|
| 2,357,110 | 8/1944 | Heineman | 72/352 |
| 2,404,304 | 7/1946 | Layton | 72/352 |
| 3,199,324 | 8/1965 | Marti | 72/256 |
| 3,605,475 | 9/1971 | Eakin, et al. | 72/256 |

FOREIGN PATENTS OR APPLICATIONS

| | | | |
|---|---|---|---|
| 129,857 | 4/1902 | Germany | 72/266 |
| 793 | 7/1909 | United Kingdom | 72/266 |

*Primary Examiner*—Lowell A. Larson
*Attorney, Agent, or Firm*—Rogers, Bereskin & Parr

[57] ABSTRACT

A method and apparatus are provided for use in converting readily- available steel tubing blanks into components having enhanced mechanical properties suitable for use in pressure vessels and the like, and more particularly the invention provides further apparatus and a method to convert such components into pressure vessel bodies.

8 Claims, 10 Drawing Figures

APPARATUS AND METHOD OF METAL FORMING

This invention relates to apparatus and a method for use in making tubular components having enhanced physical properties from tubular blanks having poorer physical properties, and more particularly to apparatus and a method used in the manufacture of pressure vessels and the like.

There are many applications where tubular components are used which require relatively accurate finishes combined with enhanced mechanical strength characteristics. For instance in drill string couplings used in terrestrial drilling; in pressure vessels used in support systems; and of late and more particularly in passive restraint systems to be used in automotive vehicles. Because of the growing importance of this last application it will be discussed in more detail. However, it is to be understood that such discussion is exemplary of other products and applications.

Pressure vessels used in automobile restraint sytems must be as light as possible while having sufficient strength to contain high pressure gases. A required volume of gas for use in inflating an air bag will require less storage volume the higher the pressure. Consequently the pressure vessel is a compromise between weight and strength to contain the pressurized gas. Another, and possibly more difficult problem, lies in pressure loss caused by leakage through the wall of the vessel. It has been found that any presently acceptable method of manufacturing thin wall pressure vessels results in a significant percentage of scrap because of leakage when the vessels are tested at elevated pressures.

At present, vessels are made in several ways: from sheet steel which has been deep drawn and subsequently welded; from steel billets which are first hot-pierced to form a cup and then cold drawn to extend the wall of the cup; and tubing which has been simply nosed or formed at both ends. Despite the use of good quality steels, pressure vessels made from these methods tend to leak at hydrostatic pressures in the range 8000 to 12,000 p.s.i. if the wall section is appreciably less than 0.200 inches thick.

Pressure vessels made by cupping and cold drawing tend to have the best characteristics among prior art structures. However, the cost of manufacturing vessels according to this method is expensive both in terms of time and equipment. Vessels made by roll forming and welding are also costly and the steel stock used requires a heavy section because it is not worked at all.

The present invention provides apparatus and a method of use for converting readily-available steel tubing blanks into components having enhanced mechanical properties suitable for use in pressure vessels and the like, and more particularly the invention provides further apparatus and a method to convert such components into pressure vessel bodies.

The invention will be better understood with reference to the drawings, in which.

Apparatus will be described initially for use in reducing the wall thickness of a tubular blank to product a component having improved mechanical characteristics. Although the blank is subject to two distinct deforming operations, the press performs one of the operations on one blank and a second of the operations on another blank in one stroke of the press as will become apparent from the following description.

Figure 1:
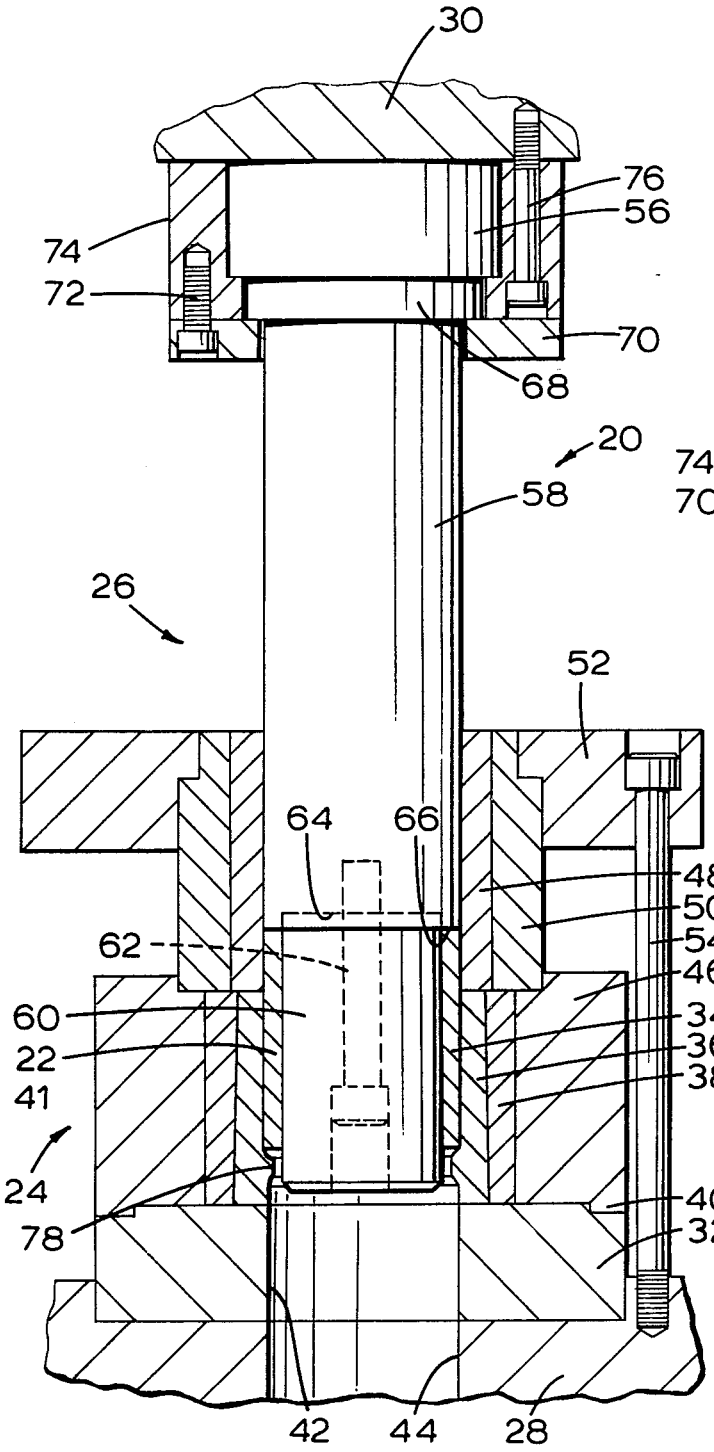
FIG. 1 illustrates apparatus used in a first press operation to convert a tubular blank into a tubular component having a thinner wall and improved mechanical properties, the apparatus being in an intermediate position where deformation of the blank is about to commence.

As seen in FIG. 1, apparatus 20 contains and engages a tubular blank 22 between a die assembly 24 and a punch assembly 26. The die assembly 24 sits on a bolster plate 28 of a press and the punch assembly 26 is attached to a ram 30 of the same press. The ram 30 is moveable from a disengaged position in which the assembly 26 is remote from the die assembly 24, through an engaged position shown in FIG. 1 and finally to a fully-advanced position shown in FIG. 2.

As seen in FIG. 1, the die assembly 24 consists of a lower die backing block 32 located in a recess formed in the bolster plate 28 and supporting a die 34 which is surrounded by respective inner and outer lower shrink rings 36, 38. As is conventional in heavy press work, these rings 36, 38 are a slight taper fit with one another and with the die 34 to permit the parts to be press-fitted to one another before use. This ensures that hoop stresses can be transmitted efficiently from the die to the rings 36 and 38. A lower face of the outer shrink ring 38 defines an annular projection 40 for engagement with a complementary upper surface of the backing block 32. This engagement ensures alignment of an opening 41 of the die 34 with respective clearance openings 42, 44 which are in alignment with one another and formed respectively in the backing block 32 and the bolster plate 28. The top surface of the shrink ring 38 defines a low annular projection 46 for concentric location of a sleeve 48 in a ring 50. The sleeve 48 is a tapered press fit in the upper shrink ring 50 and has an internal shape corresponding to that of opening 41 in the upper portion of the die 34. The opening 41 is in alignment with the opening in the sleeve and corresponds to the external cross-sectional shape of the blank 22. Similarly the openings 42, 44 in the backing block 32 and bolster plate 28 have similar cross-sections to that of a component leaving the die and are proportioned to permit free movement of the component through these openings.

Complementary surfaces are formed on the upper shrink ring 50 and a clamp ring 52 combines with elongated bolts 54 threaded into the bolster plate 28 to retain the die assembly in position on the press in alignment with the punch assembly 26.

Punch assembly 26 includes a punch backing block 56 for receiving reactive forces from a punch shank 58 to which is attached a punch tip 60. A fitted bolt 62 is recessed axially into the tip 60 and retains the tip on a lower end of the shank 58. A recess 64 is formed in the lower end of the shank to locate an end of the tip 60 and a lower end of the shank 58 defines a shoulder 66 for engagement with an upper end of the sleeve 22 to force the sleeve downwardly as will be described. The shank 58 has an external diameter which is about 0.010 inches less than the internal diameter of the sleeve 48 to allow for thermal expansion in use.

The upper end of the shank 58 defines a collar 68 which combines with a clamp ring 70 to retain the shank 58 in position relative to the ram 30 of the press. Fitted bolts 72 are used to retain the ring 70 at a lower end of a punch clamp 74 which is in turn attached to the ram 30 by fitted bolts 76 to hold the backing block 56 in position relative to the ram 30.

An important aspect of the design of the punch assembly 26 lies in the relationship between an upper end of the punch shank 58 and the combination of the clamp 74 and clamp ring 70 to permit the use of coarse commercial tube for the blanks without the need for costly refining by further drawing. Radial clearances are provided both between the shank 58 and the ring 70 and between the shank collar 68 and the lower end of the punch clamp 74. Also, the collar 68 on the shank 58 can slide radially within limits set by the radial clearances. Consequently, when the punch tip 60 engages the tubular blank 22, any radial misalignment between the punch tip and the blank 22 in the die assembly 24 can be accommodated by radial movement of the shank 58 and tip 60 within the structure attached to the ram 30. Once an axial press force is exerted of course, the friction between the upper surface of the collar 68 and the punch backing block 56 will be such that no further lateral movement will take place. However this is acceptable because once the initial radial adjustment has taken place there should be no need for further adjustment once the press operation has commenced.

In FIG. 1 the apparatus is shown in an engaged position after a lubricated tubular blank 22 has been entered into the die assembly 24 and the punch assembly 26 has then been lowered from a disengaged position clear of the die assembly 24. The punch tip 60 is slightly longer than the blank 22 for reasons which will be explained with reference to FIG. 3.

Upon further operation of the press, the ram is made to move downwardly from the FIG. 1 engaged position to apply an axial compressive force to the blank 22 so that the blank is compressively extruded through a neck 78 of the die. This neck has an upper tapered face leading downwardly into a die land. The neck has the effect in combination with the axial compressive force of creating a peripheral deforming force acting radially inwards. The press continues to apply a downward force until the punch assembly 26 has reached a fully-extended position shown in FIG. 2. At this point the blank 22 has been extruded and lengthened. Next, the punch assembly 26 is withdrawn into the disengaged position and a further lubricated blank 22' entered into the die assembly 24 before returning the punch assembly 26 to the engaged position as shown in FIG. 3.

The ram speed during the downward stroke is preferably in the range 20 to 30 inches per second to ensure that high energy forming takes place. Lower speeds will require high press tonnage and result in poorer material structure. A structure suitable for use in driving the ram is disclosed in U.S. Pat. No. 3,681,918 which issued on Aug. 8, 1972.

Figure 2:
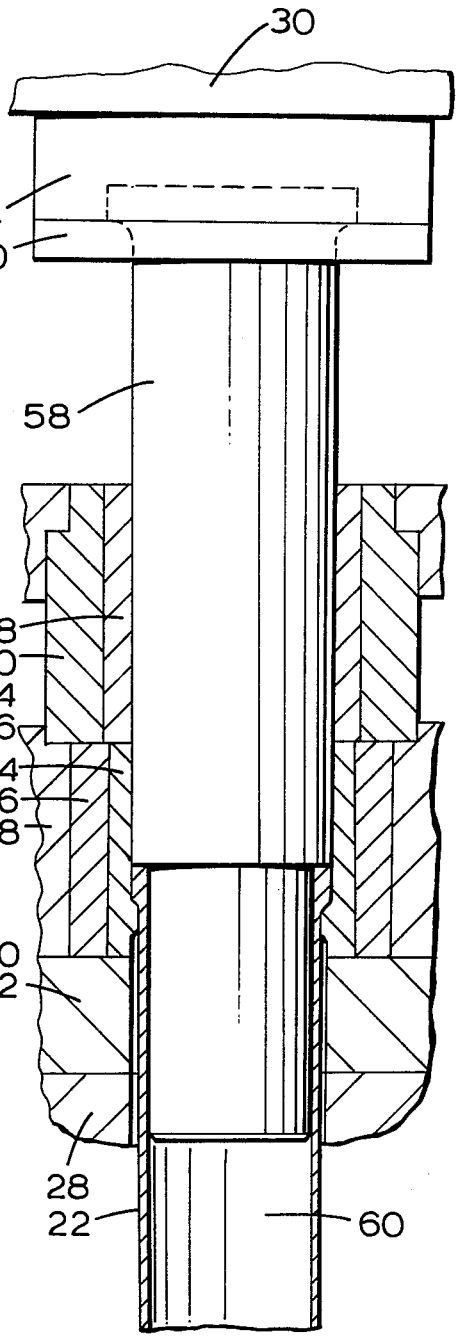
FIG. 2 illustrates the apparatus after a first press operation has been completed.
Figure 3:
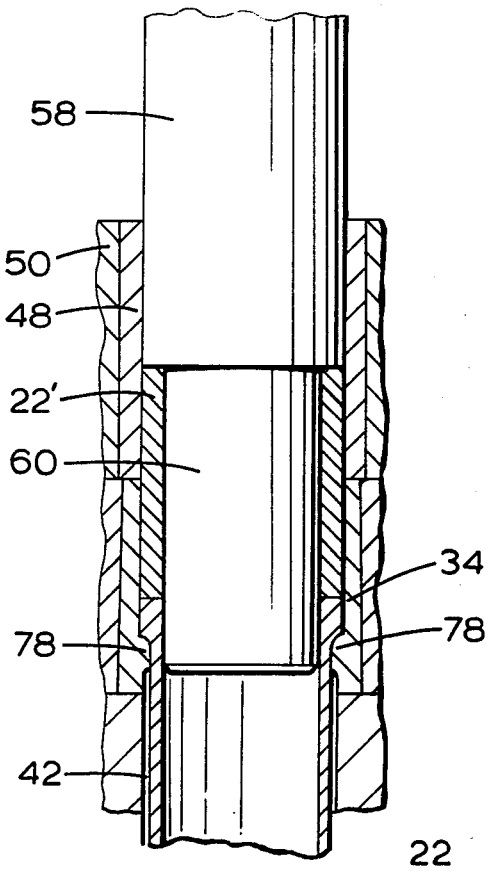
FIG. 3 illustrates another press operation using the same apparatus.

As seen in FIG. 3, with the punch assembly in the engaged position, the lower end of the punch tip 60 extends slightly beyond the upper part of the neck 78 of the die 34. Consequently, a part of the punch tip is located in the extruded blank 22. In the next operation of the press, as the punch assembly moves to the fully extended position, an upper end of blank 22 is forced through the die neck 78 and the next blank 22' is forced downwardly until it assumes a position similar to that of the blank 22 as shown in FIG. 2. As a result, the blank 22 takes on a form corresponding to that of the neck 78 of the die 34 and, although ends of the blank will require trimming, and resulting component will have well controlled tolerances and be otherwise suitable for immediate use without further machining. Each further operation of the press will complete an end portion of one blank and deform a major portion of a further blank into the shape shown in FIG. 2. Consequently, although each particular component requires two deforming operations in the press, effectively, one operation of the press produces one finished component.

Returning to FIG. 1, the arrangement of the apparatus is such that if longer tubular blanks are to be accommodated, the sleeve 48, upper shrink ring 50, and bolts 54 can be exchanged for similar parts having different axial lengths. Consequently this makes it possible to use a single disc 34 to accommodate blanks of different lengths having similar cross-sections.

The particular arrangement of the apparatus described with reference to FIGS. 1 to 3 is also advantageous in that the member of replaceable parts is limited and relatively simple to manufacture. These parts are the die 34, the punch tip 60, and the sleve 48.

Once the component has been finished and described with reference to FIG. 3, it can be trimmed and used or it can be further worked if desired. The method of manufacture has the advantage that if the relevant parts are given the necessary cross-sections, many different shapes of cross-section can be manufactured. For instance, hexagons, squares, cylinders and cylinders having partially flattened side walls for receiving wrenches and the like.

EXAMPLES

In the following results table, specimens 1 to 3 were of SAE-1026 seamless, mechanical tubing, commercial grade in the 'hot rolled' state. The fourth specimen was SAE-1340 which is a high manganese alloy steel. The chemistry analysis for both grades is as follows:

| Grade | C | Mn | P | S | Si |
|---|---|---|---|---|---|
| 1026 | .22/.28 | .60/.90 | .035 | .045 | |
| 1340 | .38/.43 | 1.60/1.90 | .035 | .040 | .20/.35 |

Both steels were hot rolled which means that they had no prior or special thermal treatment before extrusion. The hardness and tensile checks after extrusion indicated that with the same percentage Reduction In Area in the SAE-1340 alloy produced only slightly higher results than did the medium carbon SAE-1026 steel.

It will be noted that the starting outside diameter was the same in all cases. The starting internal diameter was also similar in each case as was the diameter of the punch tip. The difference in each case was the internal diameter of the neck 78 (FIG. 1) in the die 34. This difference accounts for the development of the different reductions in cross sectional area.

RESULTS TABLE

Details of Blank

| Blank No. | Material | Length (inches) | Wall Thickness (inches) | Wall Variance (inches) | Int. Dia. (inches) | Out. Dia. (inches) | Hardness Rb |
|---|---|---|---|---|---|---|---|
| 1 | SAE-1026 | 7.325 | 0.500 | 0.036 | 4.505 | 5.505 | 76–80 |
| 2 | SAE-1026 | 6.780 | 0.500 | 0.032 | 4.505 | 5.505 | 76–80 |
| 3 | SAE-1026 | 6.150 | 0.500 | 0.032 | 4.505 | 5.505 | 76–80 |
| 4 | AISI-A1340 | 6.200 | 0.500 | 0.022 | 4.505 | 5.505 | 87 |

Details of Component

| From Blank No. | Length (inches) | Wall Thickness (inches) | Wall Variance (inches) | Int. Dia. (inches) | Out. Dia. (inches) | Approx. % Reduction X-Sect. Area | Hardness RC |
|---|---|---|---|---|---|---|---|
| 1 | 14.050 | 0.202 | 0.018 | 4.501 | 4.905 | 62 | 31 |
| 2 | 13.710 | 0.176 | 0.014 | 4.500 | 4.853 | 67 | 33 |
| 3 | 14.130 | 0.152 | 0.014 | 4.502 | 4.807 | 75 | 36 |
| 4 | 14.150 | 0.154 | 0.010 | 4.497 | 4.805 | 71 | 38 |

The apparatus described with reference to FIGS. 1 to 3 also lends itself, with minor modification, to the initial steps in the production of pressure vessels used as air tanks for divers and firemen, and for other similar support systems. In particular the apparatus can be used to produce pressure vessels for use in passive restraint systems of the inflated bag type to be used in automotive vehicles. The properties of a pressure vessel produced in part using apparatus such as apparatus 20 (FIG. 1) are such that with proper control, leakage is eliminated through walls of the completed pressure vessel. This is noteworthy because the original tubular blank can be of material such as seamless steel or aluminum tubes and even from welded steel tubes. The characteristics of the resulting pressure vessel are such that the welded seam becomes essentially homogeneous with the remainder of the wall of the vessel so that leakage is eliminated from this area.

Figure 4:
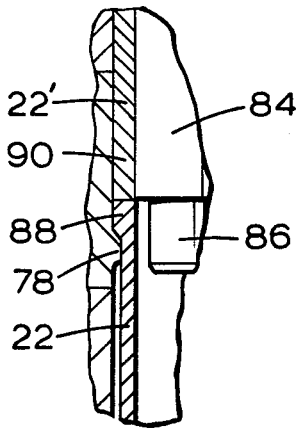
FIG. 4 is a view similar to FIG. 3 and illustrating a form of the apparatus used in the first of a series of steps to prepare a thickened boss at the end of a tubular cylindrical workpiece.
Figure 5:
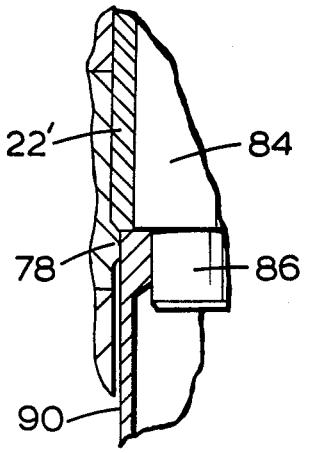
FIG. 5 is a view similar to FIG. 4 showing the apparatus executing a further step in the preparation of the boss.

In the event that a pressure vessel is to be manufactured, the apparatus 20 shown in FIG. 1 is modified to include a cylindrical punch tip 84 shown in FIG. 4. This tip includes a cylindrical end portion 86 of reduced diameter which extends downwardly into the neck 78 of the die 34 with the punch assembly 26 (FIG. 1) in the engaged position. As seen in FIG. 4 the blank 22 has an outwardly projecting radial collar 88 at its upper end and this collar is in engagement with the neck 78. The external diameter of the punch end portion 86 corresponds to the required internal diameter for the end of the blank 22. Consequently, when the further blank 22' is pushed downwardly the collar 88 is cold worked and deflected inwardly as it engages the neck 78. This inward deflection is limited by the end portion 86 of the tip 84 so that the resulting shape at the upper end of the blank 22 is as shown in FIG. 5. The new blank shape or workpiece is denoted by the numeral 90. Further downward displacement of the further blank 22' as the punch assembly 26 (FIG. 1) moves into the fully extended position releases the workpece 90 from the apparatus and the workpiece 90 is free to fall downwardly onto a conveyor or other suitable transportation apparatus. Before further operations the workpiece 90 is stress relieved by treatment in the temperature range 850° to 1050°F. for one hour. This relieves residual stresses in the material and prepares the workpiece 90 for further operations as will be described with reference to FIGS. 6 to 10.

Figure 6:
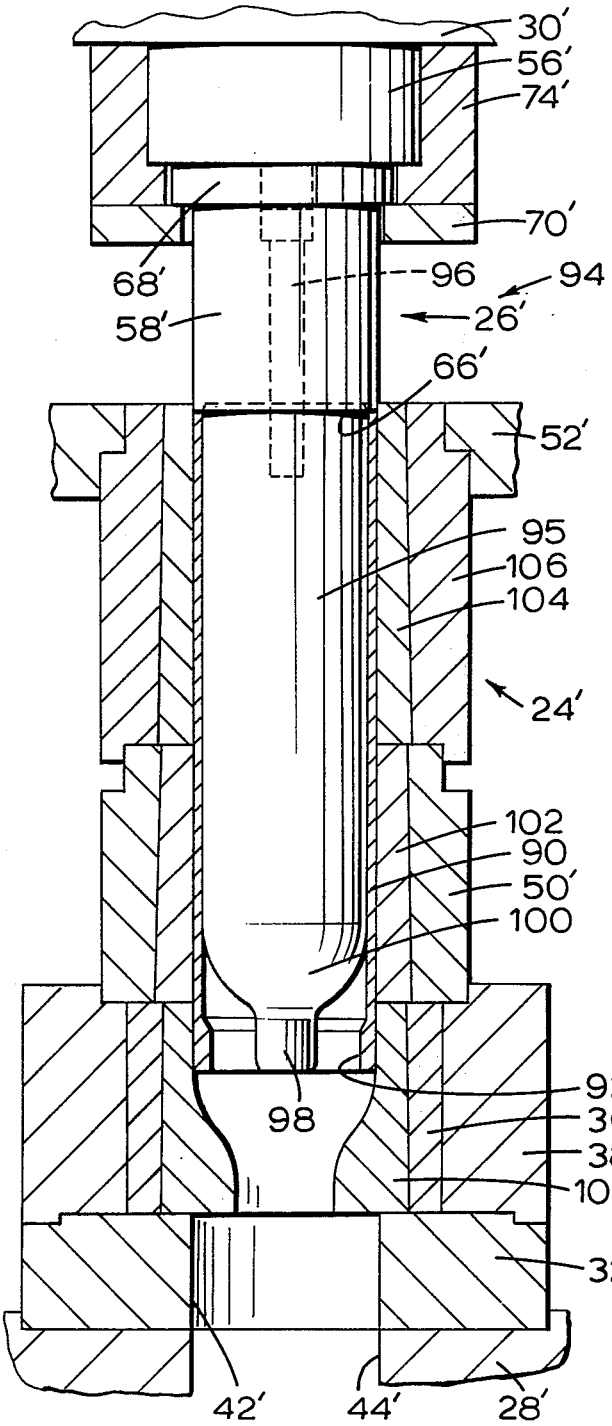
FIG. 6 is a view of apparatus used in a further press operation used to finish an end of the workpiece shown in FIGS. 4 and 5.

As seen in FIG. 6, the workpiece 90 defines an inward radial projection 92 which is now at the lower end of the workpiece. It should be noted that in some cases an acceptable result could be obtained using a tip 60 of the same length as the blank 22 so that during the second downward movement of the punch assembly the collar 88 would simply deform inwards and be finished in the next step to be described.

Figure 8:
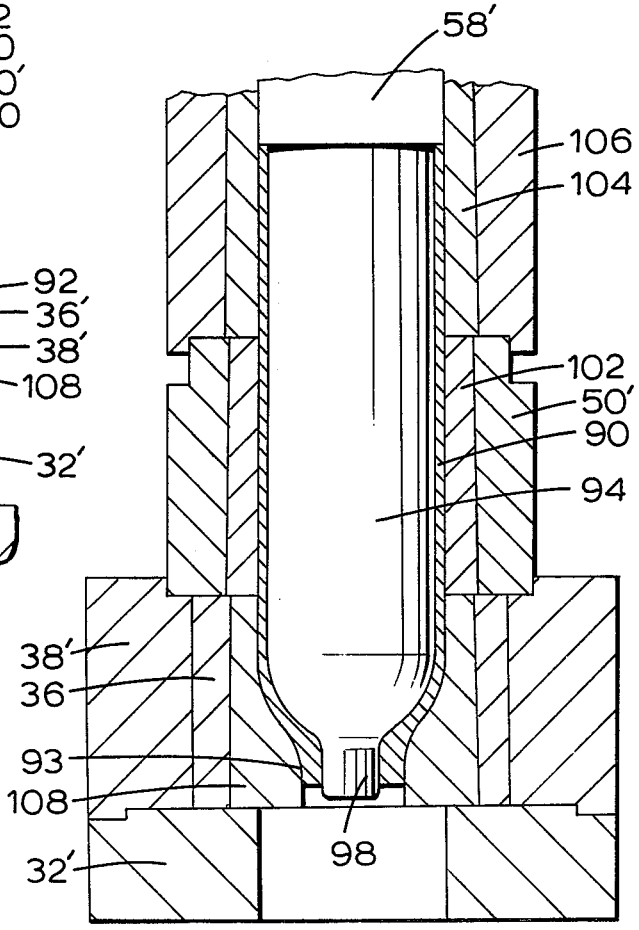

In FIG. 6, apparatus 94 is provided for cold working the lower end of the workpiece 90 into a boss 93 seen in FIG. 8. Parts of apparatus 94 shown in FIG. 6 are similar to those described with reference to FIG. 1 and will be given primed numerals when they correspond to parts already described with reference to FIG. 1. As seen in FIG. 6, the punch shank 58' has a punch tip 95 attached by a downwardly extending fitted bolt 96. The tip 95 has a generally cylindrical outer nose portion 98 having an external diameter corresponding to that of the required internal diameter of the boss 93 and a rounded inner nose portion 100 between the portion 98 and the main cylindrical portion of the punch tip 95. The external diameter of this main cylindrical portion is such that upon entry of the tip 95 into the workpiece 90 (after suitable lubrication), there is a further wall thinning in the order of 5 to 10 per cent reduction in cross-sectional area. The outward radial stresses caused by this wall thinning are supported by a lower sleeve 102 within the shrink ring 50' and an upper sleeve 104 within an uppermost shrink ring 106. As previously described, the shrink ring 50' interengages with the shrink ring 38' for concentricity. Similarly, the shrink ring 106 engages the shrink ring 50' and the clamp ring 52' engages on the shrink ring 106. Bolts corresponding to the bolts 54 (FIG. 1) retain the die assembly 24' in position.

Figure 7:
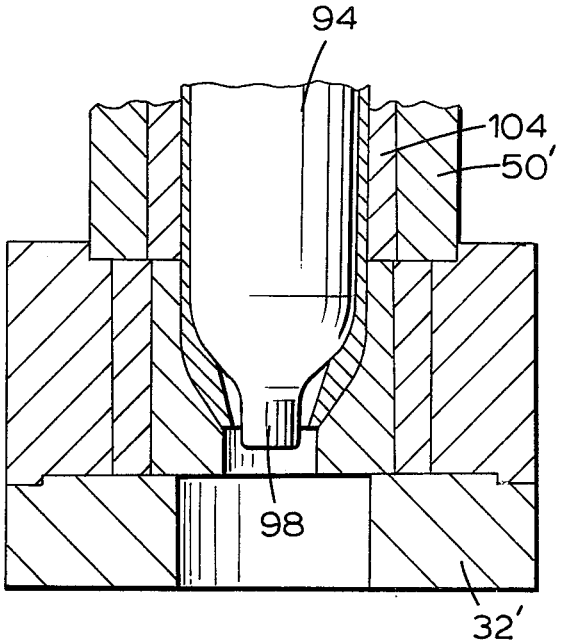
FIGS. 7 and 8 illustrate the use of the FIG. 6 apparatus.

The lowermost extremity of the punch shank 58' forms a shoulder 66' which engages the uppermost extremity of the workpice 90 for forcing the blank downwardly into a lower nosing die 108 which is in engagement with an upper surface of backing block 32'. The internal surface of the die 108 is shaped to correspond to the finished external contour required at the lower end of the workpiece 90 as seen in FIG. 8. As the punch assembly 26' moves downwardly, then the workpiece 90 engages the die assembly 24' and is deflected inwardly at its lower end as indicated in FIG. 7. Further downward force completes the deformation at the lower end so that the material of the radial projection 92 is defomed to create boss 93 (FIG. 8) and associated wall adjacent the boss which is slightly thicker than the generally cylindrical part of the workpiece. If required, an anvil can be placed under the die 108 and projecting into the die so that the lower extremity of the workpiece impacts the die to produce a finished surface on the lower end of the workpiece. Alternatively, this surface can be machined once the workpiece has been completed.

Figure 9:
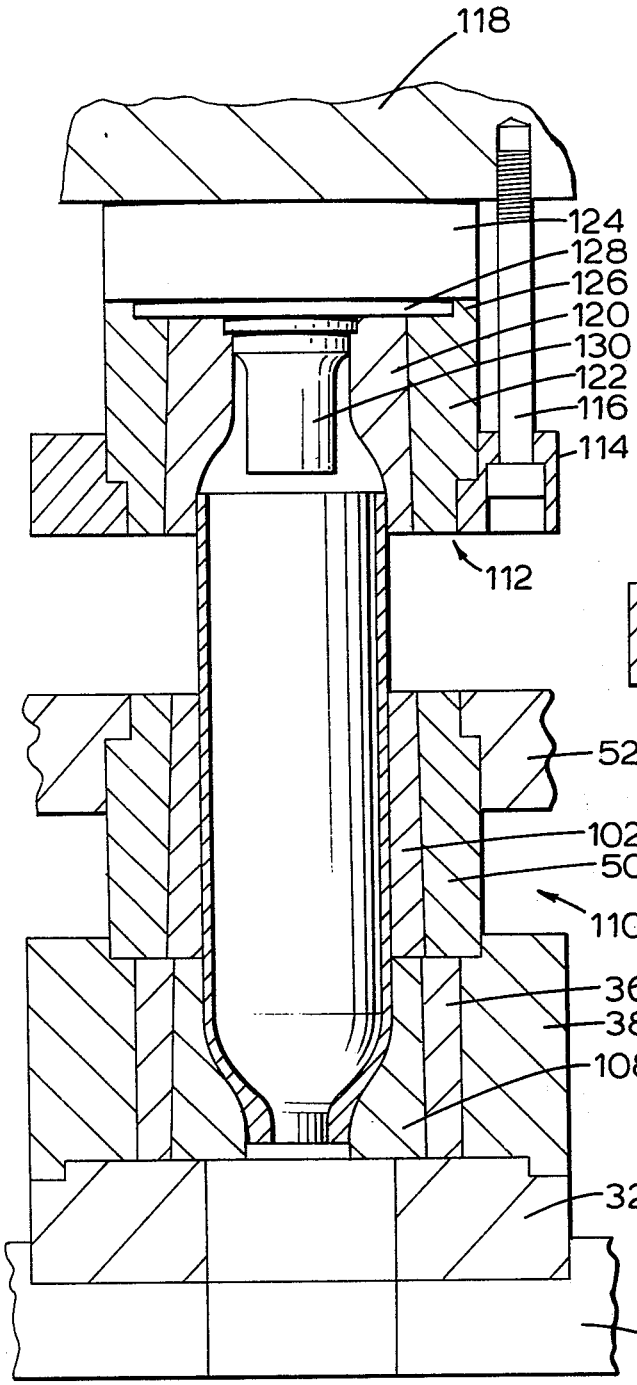
FIG. 9 illustrates further apparatus used in a press operation to form another boss at the other end of the workpiece.
Figure 10:
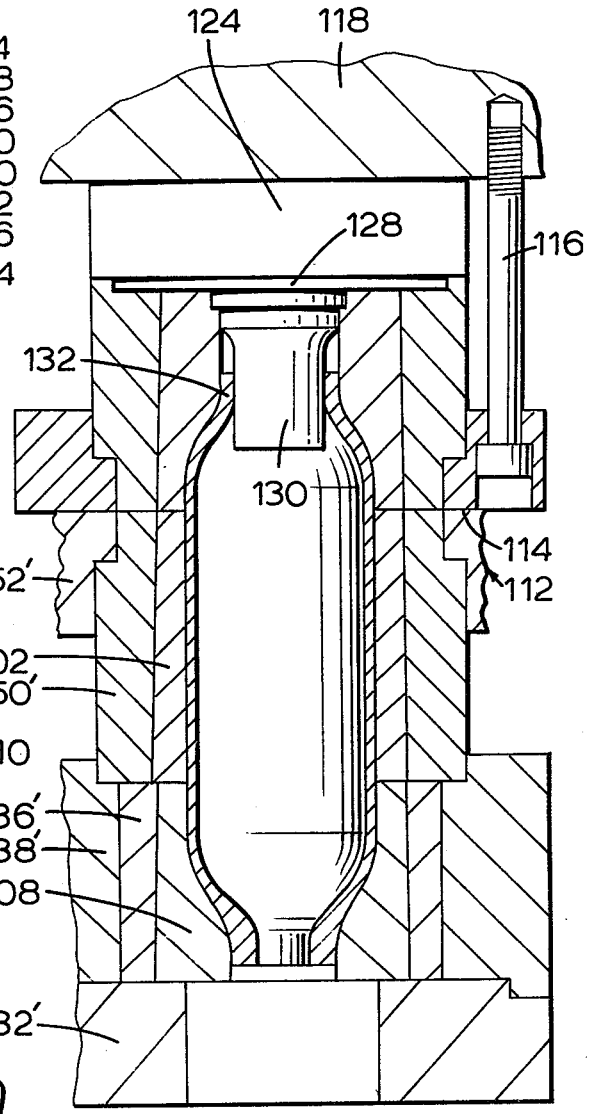
FIG. 10 is a view showing the FIG. 9 apparatus upon completion of the second boss.

The workpiece shown in FIG. 8 is ejected upwardly after first withdrawing the punch assembly 26' from the die assembly 24'. Then, the other end of the workpiece is deformed as shown in FIGS. 9 and 10 after the die assembly 24' has been modified to remove the sleeve 104 and shrink ring 106. The clamp ring 52' is then engaged on the shrink ring 50' as shown in FIG. 9. In this figure, parts corresponding to those shown in FIG. 6 are given the same numerals. The resulting die assembly 110 acts as a support for the workpiece while the upper end of the workpiece is deformed. To this end, a moving die assembly 112 is attached by a clamp ring 114 and bolts 116 to a ram 118. The clamp ring 114 is adapted to retain an upper nosing die 120 and associated shrink ring 122 in position relative to a backing block 124. The nosing die 120 is a press fit in the shrink ring 122 which has a peripheral axial projection 126 in engagement with the backing block 124. This creates a space which accommodates a flange 128 on the upper extremity of a punch 130 having an outside diameter corresponding to the required internal diameter of the upper end of the component. Consequently, the punch 130 is located to be co-axial with the nosing die 120.

Upon moving the ram 118 downwardly, the nosing die 120 moves over an upper extremity of the workpiece and as the movement continues, the wall of the workpiece is deformed inwardly following the shape of the wall of the die 120. This deformation continues until the wall of the workpiece meets the punch 130 and then the upper extremity of the wall is guided between the punch 130 and the die 120 to define a generally cylindrical boss 132 on the workpiece as seen in FIG. 10. After withdrawing the upper die from the workpiece, the workpiece can be removed from the die assembly 110. Preferably, the workpiece is then heat treated at about 1050°F. for about 30 minutes to remove any residual stresses in the material of the workpiece which is now essentially a pressure vessel body. Subsequently, the ends of this body can be machined to complete the body for receiving valving or seals as required to complete a pressure vessel.

What I claim is:

1. A method of manufacturing a tubular component for use in pressure vessels from a tubular blank, the method comprising the steps:

simultaneously applying a compressive load axially at an end of the blank and applying an inwardly directed peripheral deforming force about the blank at an opposite end thereof while supporting the blank internally so that the deforming force thins the blank locally at said opposite end and thereby lengthens the blank axially so that the grain of the blank is orientated axially;

causing relative axial movement between said end and said deforming force so that the location of the deforming force changes continuously along the blank at a speed in the range 20 to 30 inches per second until the deforming force and the blank are no longer in contact, whereupon the blank has been converted into the required tubular component and the cross-sectional area of the component is reduced by about 70% relative to the blank.

2. Apparatus for use in the manufacture of a tubular component for use in pressure vessels from a tubular blank, the apparatus comprising:

a die assembly having an opening of a cross-section corresponding to the external shape of the blank for receiving the blank, and a neck below the opening defining a neck opening of reduced cross-section and having a shape corresponding to that of the outside of the required component, an end of the blank being in engagement against the neck when the blank is in the die assembly, and the die assembly further defining a clearance opening below the neck;

a punch assembly defining a punch tip of smaller cross-section than that of the neck opening and corresponding to the internal shape of the blank for fitting closely in the blank, the tip having a length at least equal to the length of the blank, and a punch shank attached to the tip and having a cross-section corresponding to that of the external shape of the blank for entering the opening in the die assembly, an end of the shank adjacent the tip defining a shoulder for engaging an outer end of the blank remote from the neck, and in which the punch shank includes a collar at an upper end thereof, the collar defining an upper surface, and in which the punch assembly further comprises: a punch backing block in engagement with said collar upper surface; and means coupled to the ram to retain the collar in sliding contact with the backing block and to permit limited transverse movement of the collar whereby the punch tip is self-aligning as it enters the blank in the die assembly, means adapted to mount the punch assembly on a bolster plate of a press and means adapted to mount the punch assembly on a ram of said press for movement of the punch assembly axially from a disengaged position in which the punch tip is remote from the die, to an engaged position in which the tip is engaged in the blank and said shoulder is in engagement with the outer end of the blank, and further to a fully-extended position in which the blank has been almost completely forced through the neck suppoted internally by the punch tip and in which the shoulder is adjacent the neck so that there is a portion of the blank between the shoulder and the neck, the die being adapted to receive a further blank in engagement with said first-mentioned blank such that the further blank is within said opening above the neck and in engagement with the first-mentioned blank so that in moving the punch assembly from the disengaged to the fully-advanced position for a second time, the first mentioned blank is further pushed through the neck and falls as a finished component through the clearance opening while the further blank assumes the position taken by the first-mentioned blank before the introduction of the further blank into the die assembly.

3. Apparatus as claimed in claim 2 in which the blank is cylindrical and the component is also cylindrical.

4. Apparatus for use in the manufacture of a pressure vessel of the type having a generally cylindrical wall and a boss at one end of the wall, the apparatus comprising:

apparatus as claimed in claim 3 in which the punch tip is substantially the same length as the blank so that when the punch assembly is moved for the aforementioned second time, said portion of the blank is deflected inwardly in passing the neck to form an inwardly extending radial projection;

a second die assembly defining an opening having a cross-section corresponding to that of the outside of the component from the first die assembly for receiving this component with the projection lowermost; and comprising a second die having an inwardly and downwardly extending surface forming a continuation of second die opening, this surface defining the external shape of the required boss and an adjacent portion between the cylindrical wall and the boss;

a second punch assembly comprising: a second punch tip having a length about equal to that of the component and a major portion of the second punch tip having a cross-section corresponding to that of the inside of the component, this tip including an outer nose portion at the lower end of the tip and an inner nose portion joining the outer nose portion to said major portion, the nose portions defining the shape of the inside of the required boss and said adjacent portions; and a second punch shank attached to the second punch tip and having a cross-section corresponding to that of the external shape of the component for entering the opening in the second die assembly, an end of the second punch shank adjacent the second punch tip defining a second shoulder for engaging an outer end of the component remote from said radial projection;

means adapted to mount the second die assembly on said bolster plate of the press and means adapted to mount the second punch assembly on the ram of said press for movement of this punch assembly axially from a disengaged position in which the outer nose portion is remote from the second die assembly for entering the component in the opening of the second die assembly, to an engaged position in which the tip is engaged in the component and said second shoulder is in engagement with the outer end of the component, and further to a fully-extended position in which the component has been forced into engagement with said surface of the second die suppoted internally by the inner and outer nose portions of the second tip whereby the internal projection on the component and the portion of the component adjacent this projection are deformed into the shape of the boss and said adjacent portion.

5. Apparatus as claimed in claim 4 and further comprising an end portion forming an extension of the lower end of the first-mentioned tip for supporting said portion of the blank when this portion is deflected inwardly in passing the neck in the die.

6. Apparatus as claimed in claim 2 in which the die assembly comprises: a die defining said neck and a portion of the opening above the neck; and at least one sleeve above the die defining the remainder of said opening above the neck.

7. Apparatus as claimed in claim 2 in which the punch tip is at least as long as the sum of the length of a blank plus said portion of the component so that on moving the punch assembly the aforesaid second time the tip supports the first-mentioned blank internally through the neck to maintain the internal shape of the blank and hence of the tubular component.

8. A method of manufacturing a tubular cylindrical component for use in pressure vessels from a tubular blank, the method comprising the steps:

providing a die assembly having an opening of a cross-section corresponding to the external shape of the blank for receiving the blank, and having a neck below the opening defining a neck opening of reduced cross-section and having a shape corresponding to that of the outside of the required component, the die assembly further defining a clearance opening below the neck;

providing a punch assembly having a punch tip of a smaller cross-section than that of the neck opening and corresponding to the internal shape of the blank for fitting closely in the blank, the tip having a length at least equal to the length of the blank, and a punch shank attached to the tip and having a cross-section corresponding to that of the external shape of the blank for entering the opening in the die assembly, an end of the shank adjacent the tip defining a shoulder for engaging an outer end of the blank remote from the neck;

placing a blank in the opening above the neck and in engagement with the neck;

moving the punch assembly towards the die assembly so that the tip moves into the blank until the shoulder engages said upper end of the blank;

moving the punch assembly downwards to drive the blank past the neck at a speed in the range of 20 to 30 inches per second supported internally by the punch tip until the shoulder is adjacent the neck so that there is then a portion of the component between the shoulder and the neck;

withdrawing the punch tip from the die assembly;

entering a further blank into the opening above the neck and moving this blank into engagement with the first-mentioned blank;

again moving the punch assembly downwards to bring the shoulder into engagement with the further blank and to drive said portion of the first-mentioned blank through the neck to fall through said clearance opening as a finished component and to drive the further blank into the position occupied by the first-mentioned blank before the introduction of the further blank into the die assembly.

* * * * *